US005775881A

United States Patent [19]

Stich

[11] Patent Number: 5,775,881

[45] Date of Patent: Jul. 7, 1998

[54] OIL SUPPLY SYSTEM

[76] Inventor: Bodo Stich, Danziger Strasse 43a, 65191 Wiesbaden, Germany

[21] Appl. No.: 590,587

[22] Filed: Jan. 24, 1996

[30] Foreign Application Priority Data

Jan. 25, 1995 [DE] Germany ..... 195 02 235.1

[51] Int. Cl.[6] ..... F04B 23/08; F04B 23/04

[52] U.S. Cl. ..... 417/287; 417/199.1; 417/428; 417/429

[58] Field of Search ..... 417/199.1, 274, 417/286, 287, 299, 426, 428, 429; 418/3, 209, 210, 215

[56] References Cited

U.S. PATENT DOCUMENTS

| | | | |
|---|---|---|---|
| 3,415,058 | 12/1968 | Underwood et al. . | |
| 3,526,468 | 9/1970 | Moon et al. | 417/287 |
| 3,775,025 | 11/1973 | Maher, Jr. et al. | 417/426 |
| 3,985,472 | 10/1976 | Virtue et al. | 417/286 |
| 4,325,215 | 4/1982 | Yamamoto . | |
| 5,165,862 | 11/1992 | Lindblom | 417/287 |

FOREIGN PATENT DOCUMENTS

| | | |
|---|---|---|
| 1528616 | 7/1970 | Germany . |
| 4224973 | 8/1995 | Germany . |

*Primary Examiner*—Charles G. Freay

*Attorney, Agent, or Firm*—Killworth, Gottman, Hagan & Schaeff, L.L.P.

[57] ABSTRACT

The present invention relates to an oil supply system with at least one pressure and/or volume dependent controllable pump (1) and an oil tank (5) or the like from which the pump draws oil and delivers it with controlled output pressure or output volume to a system (8) to be supplied. In order to provide an oil supply system with the features described, which, using a single size of loss-free controllable pump tuned for supplying small to medium sized engine sizes, is also capable of supplying large capacity engines reliably and with optimum efficiency, and is furthermore capable of permanently supplying high performance engines when there is movement of the oil level and avoiding "dry running", it is proposed that according to the invention a constant displacement pump (2) is provided in addition to the controllable pump (1), wherein the controllable pump is configured so that in one and the same direction of revolution of its drive shaft (10), it can deliver or allow passage of the pump medium selectively in the normal pumping direction or in the opposite direction.

17 Claims, 3 Drawing Sheets

OIL SUPPLY SYSTEM

FIELD OF THE INVENTION

The present invention relates to an oil supply system with at least one pressure-dependent controllable pump and an oil tank or the like, from which the pump draws oil and delivers it under controlled pressure to a system to be supplied with oil.

BACKGROUND

Such oil supply systems are known for example as lubricant pumps in automotive vehicles. Controllable pumps in oil supply systems are generally required wherever the oil requirement or other lubricant requirement varies depending on different operating conditions of the system, as is the case, for example, with automotive vehicles. In a cold condition, the oil is viscous and the oil requirement, at least in the low revolution speed range, is low.. As the temperature rises, and with increasing revolution speed, the oil requirement of the engine also increases, so that the pump must deliver correspondingly more oil. In general such pumps are controlled dependent upon pressure, that is to say a regulating pressure is diverted from the pump outlet and supplied to an adjusting apparatus which reduces the displaced volume of the pump when the pressure increases, or increases it when the pressure reduces, so that in the end at the pump outlet a substantially constant output pressure is obtained, which is selected by means of parameters of the control system such that the system is supplied with sufficient oil or lubricant under all operating conditions. Naturally, for example in the case of an automotive vehicle engine at low revolution speeds in a cold condition, only a small volume of oil has to be delivered through the pump in order to maintain a predetermined minimum pressure, while the displaced volume has to be considerably greater when the engine has to be supplied with sufficient oil at high revolution speeds and high temperatures. The controllable pump must therefore be designed correspondingly large and robust in order to cover such a wide displacement range. In addition, loss-free controllability of the displaced flow of the pump contributes to considerable energy savings and to improvement in the efficiency of the system.

In automotive vehicle engines, there is additionally the following problem, that small engines (1,000 $cm^3$ cubic capacity) have a substantially lower maximum oil requirement than large engines and usually the space available for installing the oil pump differs greatly. This means that as a rule—for example for covering the whole range of passenger vehicles—a plurality, and at least two different pump sizes have to be used. This increases the number of parts, reduces the batch sizes and thereby has a clearly negative effect on costs, particularly with the variable displacement pumps which in themselves are more complex and expensive compared to fixed displacement pumps.

SUMMARY OF THE INVENTION

With respect to this state of the art, the object of the present invention is to provide an oil supply system with the features described in the introduction, which, using a single size of loss-free controllable pump tuned for supplying small to medium sized engine sizes, is also capable of supplying large capacity engines reliably and with optimum efficiency, and is furthermore capable of permanently supplying high performance engines when there is movement of the oil level and avoiding "dry running".

This object is solved in that in particular in the case of larger engines, a constant displacement pump is provided in addition to the controllable pump, wherein the controllable pump is configured so that in one and the same direction of revolution of its drive shaft, it can deliver or allow passage of the pump medium selectively in the normal pumping direction or in the opposite direction.

The division of one large into two correspondingly smaller pumps, only one of which is controllable and the other is a constant displacement pump, provides, in an advantageous manner, a greater flexibility of installation into the space available and an inexpensive mass production of fewer sizes, possibly a single size only, of the complex variable displacement pump. Although in principle multi-stage pumps are already known from the state of the art, in which according to requirements a first pump or a first pump chamber is connected to further pumps or pump chambers, these however do not allow comparable even control and setting up of a fixed output pressure and often also have higher energy consumption than corresponds in itself to the hydraulic capacity required. By means of the coupling according to the invention, of a constant displacement pump to a variable displacement or controllable pump, with the feature that when required the controllable pump is able to deliver or at least allow passage through in the opposite direction to its normal pumping direction, it is able to cover, without loss, the whole range of control between a zero flow rate and the maximum flow rate, defined as the sum of the maximum flow rate of the two pumps, wherein, as with a single suitably configured variable displacement pump, in all cases only the hydraulic capacity needed by the consumer system is supplied, in contrast to systems which, for example, conduct oil or other lubricant delivered in excess away through pressure control valves, which entails efficiency losses.

The reason for this advantageous behaviour of the combined system according to the invention is as follows.

From the outlet of the constant displacement pump there is a direct connection to the system to be supplied, and also to the outlet of the controlled pump, and the regulating pressure is again derived from this outlet. Assuming that, for example, only a low lubricant requirement exists, however both pumps are driven operated to an equal extent, wherein the volume flow delivered by the constant displacement pump alone is in excess of what is required, so in these operating conditions the pressure at the outlet of the controllable pump is higher than the normal delivery pressure selectable by means of the parameters of the controllable pump. That is why the variable displacement pump is inevitably adjusted by this higher pressure such that the flow direction reverses in the controllable pump, in other words because of the higher pressure which the constant displacement pump produces, a part of the oil delivered thereby is diverted and pushed through the controllable pump, which consequently acts as a motor and returns driving energy to the system rather than consuming driving energy. The excess hydraulic capacity produced by the constant displacement pump is thus regained by the controllable pump, wherein the partial flow of oil not required by the system is conducted through the controllable pump back into a sump or oil tank. The lower the requirement of the system, the greater the part of the oil conducted back via the controllable pump, wherein this also produces a correspondingly high driving power in the system. In principle, the system can therefore be suitable for a system to be supplied with as small a requirement of oil as desired.

When nevertheless the amount of oil delivered by the constant displacement pump is insufficient to supply the system, the pressure at the outlet of the pumps sinks correspondingly, whereby the displaced volume of the controllable pump is increased as the regulating pressure is derived from this outlet. In consequence, by means of the additional delivery by the controllable pump, a specific constant pressure is produced at its outlet so that in an extreme case, both pumps operate with maximum displaced volume when the system has a correspondingly high requirement.

Furthermore, it is advantageous with respect to the utilisation and the recovery of the driving energy when this is in excess of requirements, when the constant displacement pump and the controllable pump are provided with a common drive shaft or respectively drive shafts coupled in a fixed drive relationship.

For particular applications it is furthermore advantageous when a further non-return valve is integrated in the outlet line of the constant displacement pump, and an auxiliary pipe leads off in front of it, which is connected to the oil tank or to an oil sump or the like, wherein in this auxiliary pipe a second valve is provided which reacts to a mass flow or is configured as a "float valve" and is controlled by the oil level in the oil tank. This variation is of particular importance when there is the possibility that the constant displacement pump occasionally draws in air. When the constant displacement plump draws in air, this means that no oil volume is available in the take up area of the pump and consequently no mass flow is delivered. In this operating condition, the valve (controlled by mass volume or float) integrated in the auxiliary pipe is opened, so that the air delivered is conducted directly and without pressure back in the direction of the oil tank or sump. This situation can arise, for example, with automotive engines in high performance vehicles which accelerate or brake very rapidly or corner very fast. With this, the oil at the bottom of an oil tank can move backwards and forwards so much that one of the pumps draws in air. To overcome such a situation it is further provided that the two pumps have intakes which are at a distance apart from one another, and preferably the intakes open out into diametrically opposite areas of an oil tank, the base of which can also be configured so that in any acceleration situation oil is available in any case in one of the areas into which the intakes open out.

Preferably the two pumps have an equal maximum displaced volume, wherein it is understood that in the case of the constant displacement pump the maximum displaced volume is the constant volume which the displacement elements of the pump displace or deliver in one revolution, while the controllable pump can deliver any volume between zero and its maximum displaced volume to the consumer system, and in the configuration according to the invention can even run in the opposite direction, wherein it then runs not as a pump but instead as a hydraulic motor, which is driven by oil delivered in excess by the constant displacement pump.

Furthermore a configuration of the supply system is preferred in which at least the controllable pump is a vane cell pump, wherein preferably the constant displacement pump is also configured as a vane cell pump. It is precisely in the case of vane cell pumps that the reversal of the flow direction of the pumping medium through the pump while the pump drive shaft continues to rotate in the same direction can be easily implemented, in that eccentricity of the setting ring of the pump relative to its rotor is allowed to be possible not only between the centred position and over to one side, but additionally over to the opposite side.

Further advantages, features and possible applications of the present invention will be made clear with reference to the following description and the drawings associated with it. These show in:

DETAILED DESCRIPTION OF THE INVENTION

Figure 1:
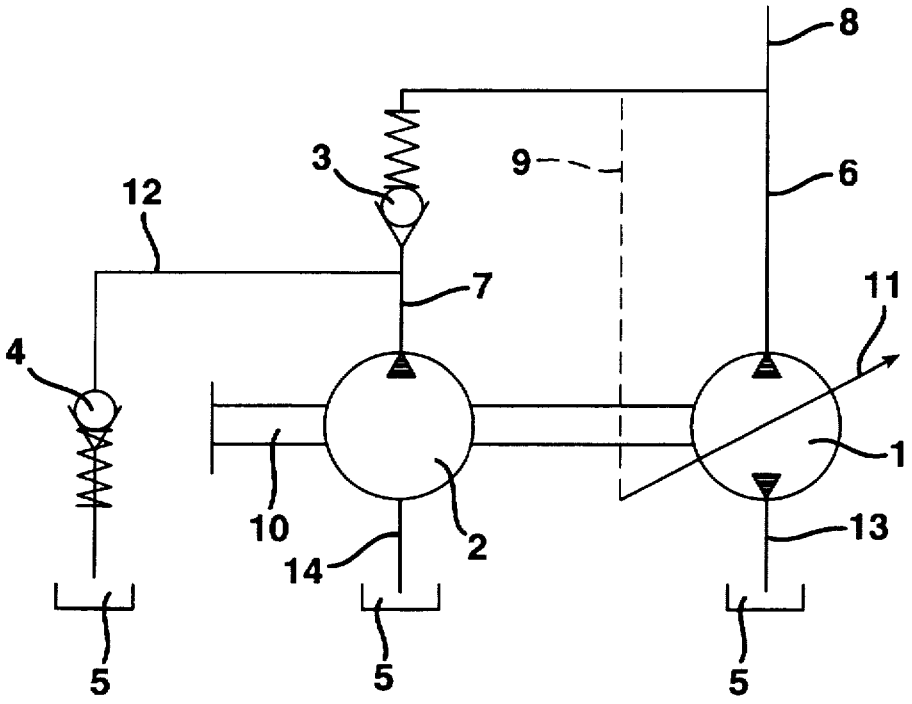
FIG. 1 a flow chart of a preferred embodiment of the oil supply system according to the invention.

In FIG. 1 the individual elements of the oil supply system are simply represented schematically. On the right-hand side, in the centre, a controllable pump 1 is shown, which is provided with a drive shaft 10 in common with a constant displacement pump 2 shown in the centre. This means the two pumps 1, 2 are both driven at the same revolution speed. Preferably the two pumps are configured as vane cell pumps and designed, for example, for the lubricant supply system of an automotive vehicle.

While the constant displacement pump 2 delivers constant amounts of lubricant at a given revolution speed, with the controllable pump 1, the delivered amount depends on the pressure prevailing at its outlet 6 or in the system 8 to be supplied. This pressure is supplied by means of a control line 9 to corresponding adjusting members of the control system of the pump 1, which in the case of a vane cell pump can, for example, be configured so that a piston moves an adjusting ring defining the pumping space, against the opposing pressure of a spring, relatively to a rotor rotating therein, towards lesser or greater eccentricity. Reference may be made with respect to this to German patents nos. 33 33 647 and 40 11 671 of the present applicant, the content of which is included here by reference.

The two pumps each have an intake 13 and respectively 14, wherein the two intakes 13, 14 preferably open out at a distance from one another and particularly preferably in diametrically oppositely located areas of a common oil tank 5, wherein FIG. 1 shows the oil tank 5 several times separately as a symbol, but indicates in each case one and the same oil tank and different positions inside it.

At the outlet 7 of the constant displacement pump 2 a division is provided. One of the branches runs via a non-return valve 3 to the system 8 to be supplied with oil. The other branch runs via a second valve 4 back to the oil tank 5. With this, the non-return valve 3 which opens in the direction of pumping of the constant displacement pump 2 is slightly pre-tensioned by a spring in the direction of closure, while conversely the valve 4 which leads back to the oil tank is arranged so that it closes in the normal pumping direction of the constant displacement pump 2, wherein it is either pre-tensioned by a spring in the direction of opening, or actuated by a float controlled by the oil level. As a result, when there is no oil flow (mass flow) produced at the outlet of the pump 7, the non-return valve 3 remains closed and the medium is pumped back into the oil tank 5 via the auxiliary line 12 and the valve 4 which is configured either as a mass flow or oil-level/float controlled valve. This is typically the case when the pump 2 draws in air. In other words, as soon as the pump 2 draws in air, the non-return valve 3 closes as a result of the pre-tensioning of its spring, while the valve 4 opens or remains open so that the air is returned to the oil tank. However, if the pump 2 draws in oil there is suddenly a mass flow which closes the valve 4 and opens the first non-return valve 3, so that the system 8 is then supplied with oil. If any possible loss of pressure in the non-return valve is ignored, it can be said that the outlet pressure of the pump 2 is also simultaneously applied via the control line 9 to the control system of the controllable pump 1. The outlet 6 of the controllable pump 1 also has substantially the same pressure. The influence that this type of hydraulic switching has on the manner of operating of the controllable pump 1 is best described with reference to different situations. If the system to be supplied with oil has a relatively high requirement, which cannot be covered by the constant displacement pump alone, the pressure at the outlet 7 of the constant displacement pump and also in the control line 9 of the controllable pump 1 is correspondingly low. This means that the control system 11 adjusts the controllable pump 1 in the direction of its maximum displaced volume, so that the two pumps 1 and 2 together cover the requirement of the system 8 to be supplied with oil, the result of which leads to a higher pressure at the outlet of both pumps and also in the control line 9, wherein the control characteristic of a controllable pump is typically configured so that under all operating conditions there is a substantially constant pressure at the outlets 6, 7 and in the control line 9, as well as in the system 8 to be supplied.

If on the other hand the requirement of the system 8 to be supplied with oil is less than that corresponding to the delivery capacity of the constant displacement pump 2, the pressure must inevitably increase at its outlet 7 and consequently also in the control line 9 and at the outlet 6 of the controllable pump. With this, the control system 11 can not only throttle the pump 1 so far that its displaced volume reduces to zero, but even so far that the oil flows in the opposite direction. In the case of a vane cell pump, this is very easy to understand, when the eccentricity of the adjustment ring moves the vane to the pump relative to the central rotor from one side to the other side.

In this case, the excess oil delivered by the constant displacement pump 2 is pushed through the controllable pump 1 in the opposite direction, so that the rotor of this pump is driven by the oil being pushed through, which represents a hydraulic energy or capacity, and consequently this driving force is transferred back to the constant displacement pump 2 via the shaft 10. With this correspondingly less energy is taken from the common drive system for the shaft 10 of both pumps 1 and 2. Although the constant displacement pump has a constant displaced volume at a given revolution speed, which may be greater than the actual requirement of the system to be supplied, because of this coupling together the system to be supplied with oil receives only the amount of oil which it actually needs, while excess oil is returned via the controllable pump 1, which operates in this case as a motor, and consequently also reduces the driving energy which is necessary for driving the constant displacement pump 1, so that this essentially needs only the driving energy which is necessary for the delivery of the part of the oil in the system to be supplied with oil. This manner of functioning of the system according to the invention is shown in FIG. 2.

Figure 2:
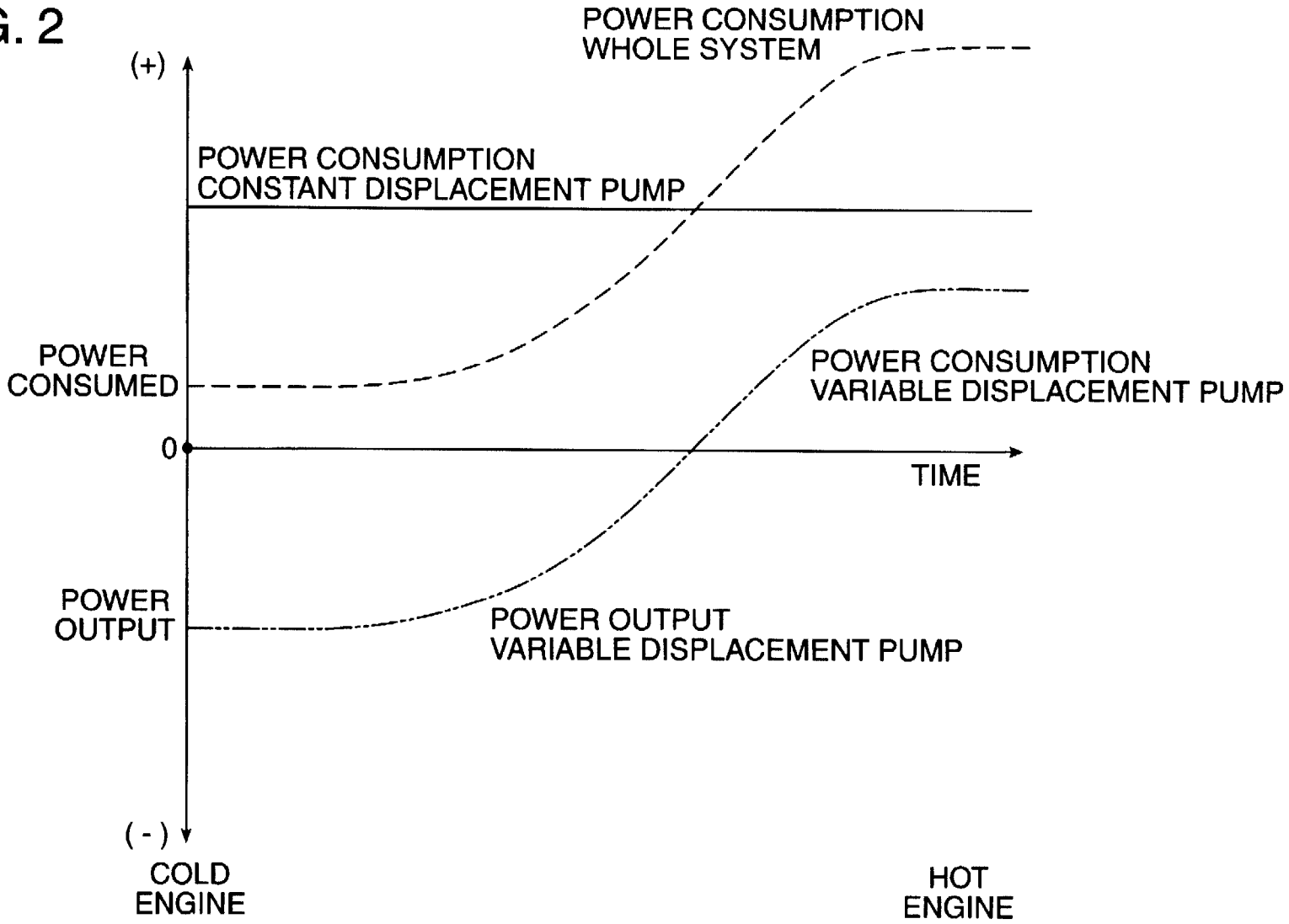
FIG. 2 a diagram of the power consumption of the oil supply system in a first operating state, and FIG. 3 a diagram of the power consumption of the oil supply system in a second operating state.

In FIG. 2 the capacity of the constant displacement pump and of the controllable pump is shown vertically, whereby the power consumption of the constant displacement pump is shown by a solid line and the power consumption or output of the controllable pump is shown by a broken line. The power consumption of the whole system is represented by a dashed line. The time is shown in the horizontal direction in FIG. 2. FIG. 2 shows, by way of example, the power consumption during hot running of a combustion engine.

At the beginning of the time segment being considered, the system to be supplied at first has a constant, very low oil requirement, which afterwards increases and then remains constant when the operating mode of the engine also remains constant. This corresponds exactly to the power consumption of the whole system, corresponding to the dashed line. In detail, the supply of oil by the two pumps runs parallel, which pumps, however, consume different amounts of energy from the external system, wherein in the case according to FIG. 2, only the whole power consumption of the individual pumps is shown, without taking into consideration from where the corresponding drive power is provided. In addition it is assumed in this case, for reasons of simplification and clarity, that the pumps operate with constant revolution speed and an adjustment according to requirements is simply done by corresponding adjustment of the controllable pump.

Accordingly, during the whole time segment being considered, the constant displacement pump consumes a constant amount of power. The power consumption of the variable displacement pump varies on the other hand with the oil requirement and consequently also with the power requirement of the whole system. At the beginning of the time period being considered the engine operation requires a considerably lower hydraulic capacity than is made available by the constant displacement pump. Consequently the controllable pump goes immediately into motor operation and converts the excess hydraulic capacity into mechanical capacity and returns this via the common drive shaft to the constant displacement pump which leads to a corresponding reduction in the power consumed by the whole system. If the oil requirement now increases as the engine becomes warmer, the displaced volume of the constant displacement pump at some point is no longer sufficient for maintaining the pressure pre-determined at the controller and the variable displacement pump converts from motor to pump operation.

In general, the following power balance applies:
Power consumed by the whole system is equal to the sum of the capacities of the constant displacement pump and the variable displacement pump.

$$P_W = P_C + P_V$$

wherein the preceding sign of the variable displacement pump capacity can be positive or negative according to the type of operation.

Figure 3:
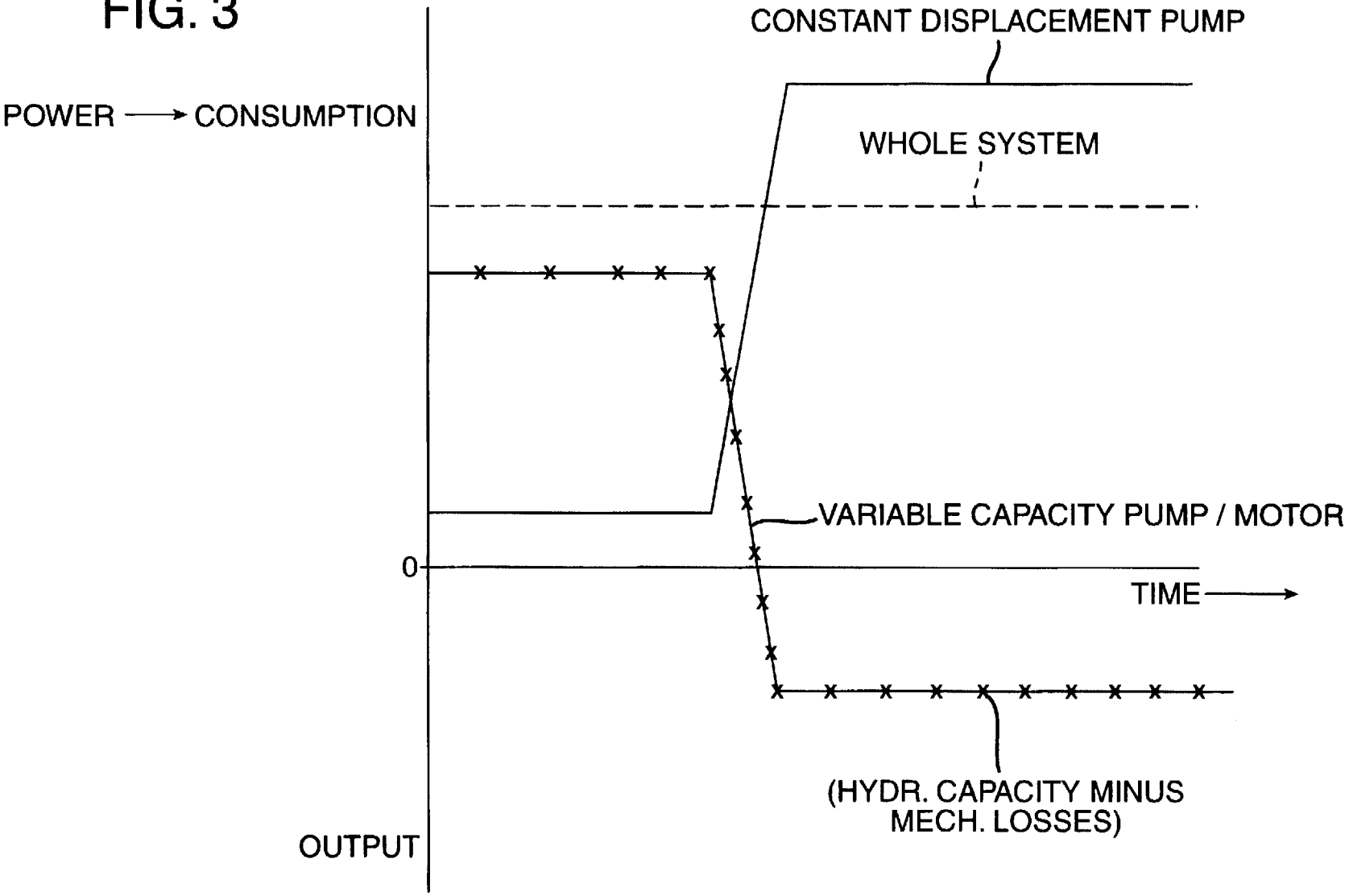

FIG. 3 shows yet another mode of operation of the oil supply system, as can occur for example in a high performance engine, in which each of the two pumps 1, 2 itself delivers sufficient oil for operating the engine, wherein however dependent on external forces, for example during acceleration, braking or cornering, the intakes of one of the two pumps is not immersed in oil. In FIG. 3 such a situation is shown as a function of time, wherein it is assumed that at the beginning of the time period being considered, the oil supply is done essentially by means of the controllable pump, while the intakes of the constant displacement pump 2 essentially only draw in oil vapour and touche only a small quantity of oil. As a result of this, the oil supply is essentially undertaken by the controllable pump 1, which maintains a specific oil pressure in the engine or consumption points by means of its control system 11. When there are constant external conditions, the power consumption of the controllable pump 1 is also substantially constant, as shown by the crosses indicated at the beginning of the horizontal line. The constant displacement pump 2, which as already mentioned essentially only draws in oil vapour, consumes relatively little power as is shown by the lower solid horizontal line. In this operating state, the valve 3 pre-tensioned in the direction of closure remains closed, while the mass flow or float controlled valve 4 remains open so that the outlet of the constant displacement pump 2 is ventilated without pressure.

As soon as the intake of the constant displacement pump becomes immersed, because of rapid cornering or acceleration, in oil stored in an oil tank, the power consumption of the constant displacement pump increases within a short time to its constant and at the same time maximum value for the given speed of revolutions. As soon as oil is present at the outlet 7 of the constant displacement pump 2, the valve 4 closes and the valve 3 opens, wherein from now the outlet pressure of the constant displacement pump is also applied to the control inlet 9 of the controllable pump 1. As it is assumed that in the present case each of the pumps is dimensioned sufficiently in itself and with a certain safety clearance, in order to supply the whole system with oil, the actual capacity of the constant displacement pump 2 is generally greater than the current requirement, which leads inter alia to a part of the oil being returned to the pump sump 5 via the outlet 6 and the inlet 13 of the variable displacement pump because of the prevailing pressure and a corresponding adjustment of the control system 11, in other words the adjustment of the controllable pump is carried out, proceeding from the initial pump setting first to zero delivery and beyond zero delivery so that the controllable pump 1 from now in does not operate as a pump but instead as a hydraulic motor. As the drive shaft of the variable displacement pump 1 is coupled with the drive shaft of the constant displacement pump 2, in this way the constant displacement pump receives back a part of the hydraulic capacity it consumed in total and output in the form of the pumped in oil into the system, from the variable displacement pump, so that the whole power consumption substantially corresponding to the whole oil requirement of the oil consumption points less any mechanical loss which can occur in the pumps 1 and 2.

Seen from the outside, the power consumption of the whole system remains constant (see upper broken line) wherein the constant displacement pump 2 seen on its own consumes more power, however the excess power consumption is compensated for by the controllable pump operating as a motor, as the constant displacement pump delivers more oil than the whole system requires. The control system 11 of the variable displacement pump 1 and the possible operation of the variable displacement pump as a motor act simultaneously in this respect as a pressure limiter for the whole system.

Naturally, the essential cooperation of the two pumps and a corresponding distribution of the mechanical power input as explained with reference to FIGS. 2 and 3, still remains when the revolution speeds and delivery rates of the two pumps change, which means the same as the power consumption of the constant displacement pump changing over time. It can also be the case that the curve of the whole power consumption intersects the curve of the power consumption of the constant displacement pump, which according to the description given above means the same as a part of the drive power for the constant displacement pump, because of an excess delivery thereof, being returned through the controllable pump, through which the excess flows back into an oil tank.

What is claimed is:

1. Oil supply system comprising a controllable pump, an oil tank from which said controllable pump draws and delivers oil to a system to be supplied with oil, and a constant displacement pump, said controllable pump and said constant displacement pump having at least one of a common rotatable drive shaft or coupled drive shafts, wherein said controllable pump is controlled by pressure derived from a common output of said constant displacement pump and said controllable pump and is configured to allow passage of a pump medium selectively in a normal pumping direction and an opposite direction, in one and the same direction of revolution of said drive shaft; and wherein said controllable pump acts as a hydraulic motor when said pumping medium is pumped in said opposite direction.

2. Oil supply system according to claim 1, characterised in that said constant displacement pump has an outlet connected via a first non-return valve to an outlet, or said controllable pump and the system to be supplied with oil.

3. Oil supply system according to claim 2, characterised in that said first non-return valve is pre-tensioned in a direction opposite the pumping direction of said constant displacement pump.

4. Oil supply system according to claim 2, characterised in that the outlet of said constant displacement pump is connected via an auxiliary line branching off in front of said first non-return valve to said oil tank, wherein said auxiliary line contains a selectably openable and closeable valve.

5. Oil supply system according to claim 4, characterised in that the valve of said auxiliary line closes in the direction of said constant displacement pump but is pre-tensioned in an opening direction.

6. Oil supply system according to claim 4, characterised in that the valve of said auxiliary line is at least one in a group consisting of a mass flow valve and a float controlled valve.

7. Oil supply system according to claim 1, characterised in that said constant displacement pump and said variable displacement pump having a substantially equal maximum displaced volume.

8. Oil supply system according to claim 1, characterised in that said controllable pump and said constant displacement pump have intakes distanced apart from one another.

9. Oil supply system according to claim 8, characterised in that the intakes of said controllable pump and said constant displacement pump open out into diametrically opposite areas of said oil tank.

10. Oil supply system according to claim 1, characterised in that said controllable pump is a controllable vane cell pump.

11. Oil supply system according to claim 1, characterised in that said constant displacement pump is a vane cell pump.

12. Oil supply system according to claim 3, characterised in that the outlet of said constant displacement pump is connected via an auxiliary line branching off in front of said first non-return valve to said oil tank, wherein said auxiliary line contains a selectably openable and closeable valve.

13. Oil supply system according to claim 12, characterised in that the valve of said auxiliary line closes in the direction of said constant displacement pump but is pre-tensioned in an opening direction.

14. Oil supply system according to claim 6, characterised in that said constant displacement pump and said variable displacement pump having a substantially equal maximum displaced volume.

15. Oil supply system according to claim 2, characterised in that said controllable pump and said constant displacement pump have intakes distanced apart from one another.

16. Oil supply system according to claim 9, characterised in that said controllable pump is a controllable vane cell pump.

17. Oil supply system according to claim 9, characterised in that said constant displacement pump is a vane cell pump.

* * * * *